US009869118B2

(12) United States Patent
Schmidt

(10) Patent No.: US 9,869,118 B2
(45) Date of Patent: Jan. 16, 2018

(54) DUAL MANUAL DISENGAGEMENT MECHANISM FOR AN ELECTRIC TRANSIT DOOR OPERATOR

(71) Applicant: Westinghouse Air Brake Technologies Corporation, Wilmerding, PA (US)

(72) Inventor: Timothy R. Schmidt, Wheeling, IL (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 455 days.

(21) Appl. No.: 14/679,313

(22) Filed: Apr. 6, 2015

(65) Prior Publication Data

US 2016/0290027 A1 Oct. 6, 2016

(51) Int. Cl.

| | |
|---|---|
| ***E05F 15/00*** | (2015.01) |
| ***E05F 15/657*** | (2015.01) |
| ***E05F 15/63*** | (2015.01) |
| ***E05F 15/662*** | (2015.01) |

(52) U.S. Cl.

CPC ..... *E05F 15/657* (2015.01); *E05F 15/63* (2015.01); *E05F 15/662* (2015.01); *E05Y 2900/51* (2013.01)

(58) Field of Classification Search

CPC ..... F05F 15/657; F05F 15/63; F05F 15/662
See application file for complete search history.

(56) References Cited

U.S. PATENT DOCUMENTS

| | | | | |
|---|---|---|---|---|
| 2,893,506 | A * | 7/1959 | Daugirdas | E05F 15/40 180/286 |
| 5,332,279 | A * | 7/1994 | Golemis | B60J 5/0497 192/69.6 |
| 6,021,871 | A * | 2/2000 | Grabner | B66B 13/12 187/335 |
| 6,575,864 | B1 | 6/2003 | Dean | |
| 7,946,079 | B2 * | 5/2011 | Brown | E05F 17/004 49/118 |
| 8,484,892 | B2 * | 7/2013 | Giannis | E05F 15/40 49/116 |
| 8,527,101 | B2 * | 9/2013 | Burris | E05F 3/102 16/71 |
| 8,991,878 | B2 | 3/2015 | Beck et al. | |
| 8,997,401 | B2 * | 4/2015 | Kowalczyk | E05D 15/54 49/122 |
| 9,010,023 | B2 * | 4/2015 | Chapman | B61D 19/02 49/117 |
| 9,322,204 | B2 * | 4/2016 | Suzuki | E05F 15/611 |
| 2003/0089041 | A1 * | 5/2003 | Daniels | E05F 15/619 49/341 |

(Continued)

*Primary Examiner* — David M Fenstermacher
(74) *Attorney, Agent, or Firm* — The Webb Law Firm

(57) ABSTRACT

A dual manual disengagement mechanism for an electric transit door operator having a disengagement shaft extending from the operator comprises a first pinion lever (3) secured to the disengagement shaft, a second pinion lever (14) intermeshed with the first pinion gear, a first cable (17) connected to the first pinion-lever via a clevis end (15) having an elongate slot, a second cable (23) connected to the second pinion lever via a clevis end (16) having an elongate slot. The length of the slots in the clevis ends is such that the pulling of one cable to rotate the disengagement shaft will not cause a tug on the other cable.

6 Claims, 4 Drawing Sheets

(56) References Cited

U.S. PATENT DOCUMENTS

| | | | | |
|---|---|---|---|---|
| 2003/0205000 | A1* | 11/2003 | Pagowski | B61D 19/02 49/341 |
| 2005/0132652 | A1* | 6/2005 | Tong | B60J 5/062 49/334 |
| 2010/0050523 | A1 | 3/2010 | Helms et al. | |
| 2012/0291354 | A1 | 11/2012 | Giannis | |

* cited by examiner

PRIOR ART

DUAL MANUAL DISENGAGEMENT MECHANISM FOR AN ELECTRIC TRANSIT DOOR OPERATOR

BACKGROUND OF THE INVENTION

1. Field of the Invention

This invention relates to door operators for doors on transit vehicles such as buses and trains. Some vehicle doors have a single panel mounted at an outside edge of the door opening. Many vehicle doors have two panels, each mounted at an outside edge of the door opening. The panels usually swing outward to permit entrance or exit of passengers. Often, the doors are caused to open or close with a pneumatic cylinder or electric motor and a well-known teeter assembly mounted over the top of the door opening. The space available for mounting the door operator over the door opening is often limited. Automatic opening and closing of the doors is controlled by the vehicle driver at stops for picking up and discharging passengers. It is an essential feature of door operators that the doors cannot be pushed open by passengers leaning against the doors, for example, while the vehicle is moving. However, in an emergency there must be a manual release that can be operated by a passenger. Generally, passengers must be able to operate the manual release with no more than 20 pounds pull force.

2. Description of Related Art

U.S. Pat. No. 5,332,279 entitled "Power Door Operator for Multi-Passenger Mass Transit Vehicles" discloses an electric door operator and illustrates the manner in which the spaced doors are rotated open and closed by the action of the teeter assembly connected to drive rods and pivot levers fixed to the vertical door shafts on which the doors are mounted. (See FIG. 1.)

U.S. Pat. No. 8,484,892 entitled "Electric Door Operator" discloses an electric door operator having a teeter 34 mounted on an output shaft 36. The teeter 34 has a drive arm 35 mounted to the output shaft 36 with journals at one or both ends for receiving drive rods. The teeter can rotate both clockwise and counterclockwise to operate the drive rods. Mounted on opposite sides of the housing are an electric motor 42 and an electric brake 44 connected to each end of an input (motor) shaft 46. The electric motor can be controlled to rotate either clockwise or counterclockwise. (See FIG. 2.)

The electric motor is coupled to the input shaft at one end and to the electric brake mounted to the input shaft, for example, at the other end. The electric brake is spring biased in the braking position with an electric release. An electromagnetic coil inside the electric brake releases a spring actuation such that when no electric power is available, the motor shaft is locked in position. Thus, a passenger leaning on a door will not force it open. Electric power is only required to open or close the doors and not to maintain the doors closed, Other fail safe braking systems can be used.

Mounted on the input shaft is a worm. A gear shaft is mounted rotatably, and preferably, perpendicular to the input shaft. A worm gear is fixed to the gear shaft in a position to engage the worm. A gear train connects the gear shaft to the teeter shaft. Within the gear train, a pinion has a sliding connection enabling axial movement between engaged and disengaged positions.

A manual release shaft is rotatable perpendicular to the housing. Rotation of the manual release shaft moves a cam mechanism that affects the movement of the sliding pinion. This arrangement allows for the emergency release of the input (motor) shaft from the teeter shaft permitting manual opening of the door in an emergency. The manual release shaft is spring biased in the engaged position.

An engagement/disengagement cam secured to the manual release shaft has spaced engagement cam surface portions and disengagement cam surface portions. An electrically operated actuator, for example, a solenoid, is fixed to the housing for pulling a spring biased stop away from the disengagement cam such that with the rotation of the manual release shaft the engagement/disengagement cam allows the spring biased stop to enter the disengagement cam surface portion preventing return of the sliding pinion to the engaged position until the solenoid is activated. Typically, actuation of the solenoid is only controlled by the vehicle operator.

In order to return the transit doors to an operational state, the solenoid is used to retract the stop to allow the manual release shaft to rotate back to the operational position. Such rotation of the lever is accomplished by a torsion spring around the manual release shaft urging the sliding pinion to the engagement position.

The primary disadvantage of this system is that the disengagement lever is only configured to accept a single mechanical input. Secondarily, the use of sheathed cables for the mechanical input imposes practical limits on the positioning of the disengagement lever. Applicant's invention overcomes these limitations by incorporating additional linkage enabling additional inputs without interfering with a primary release cable.

SUMMARY OF THE INVENTION

Briefly, according to this invention, there is provided a dual manual disengagement mechanism for an electric transit door operator having a disengagement shaft extending from the operator comprising: a first pinion lever secured to the disengagement shaft having a plurality of gear teeth; a second pinion lever having a plurality of gear teeth intermeshed with the gear teeth of the first pinion lever such that when the first lever rotates with the disengagement shaft the second lever also rotates and vice versa; a first pull means connected to the first pinion lever via a clevis end having an elongate slot, said first pull means extending in a first direction; and a second pull means connected to the second pinion lever via a clevis end having an elongate slot, said second pull means extending in a second direction generally opposite the first direction, and wherein the length of the slots in the clevis ends is such that the pulling of one pull means to rotate the disengagement shaft to the disengagement position will not cause a tug on the other pull means.

According to a preferred embodiment, the pull means are sheathed cables.

According to another embodiment, the first and second pinion levers are of equal length and the clevis ends have slots of equal length.

According to another embodiment, the first and second pinion levers are of unequal length and the clevis ends have slots of unequal length.

BRIEF DESCRIPTION OF THE DRAWINGS

Further features and other objects and advantages will be understood from the following detailed description made with reference to the drawings in which.

DESCRIPTION OF THE INVENTION

Figure 1:
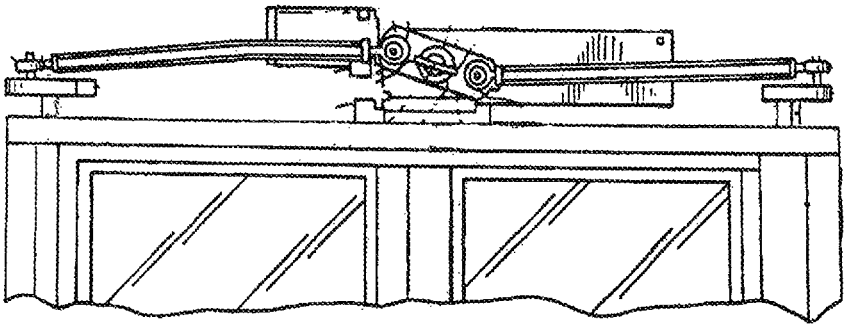
FIG. 1 illustrates a prior art vehicle door controlled by an electric door operator and teeter assembly.
Figure 2:
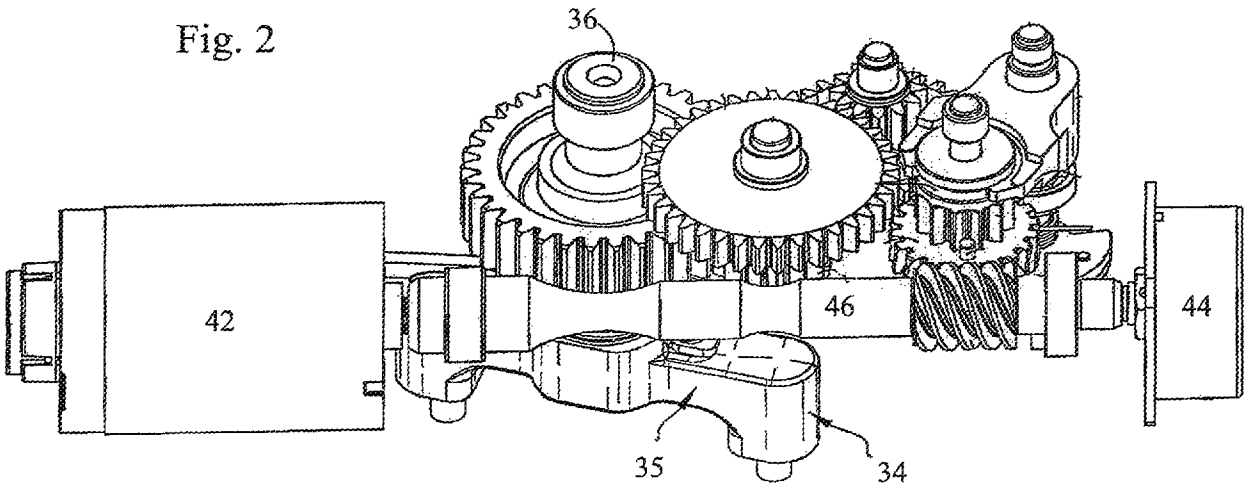
Fig. 2 PRIOR ART
FIG. 2 illustrates a prior art electric door operator having an electric motor and an electric brake at opposite ends of an output (motor) shaft.
Figure 3:
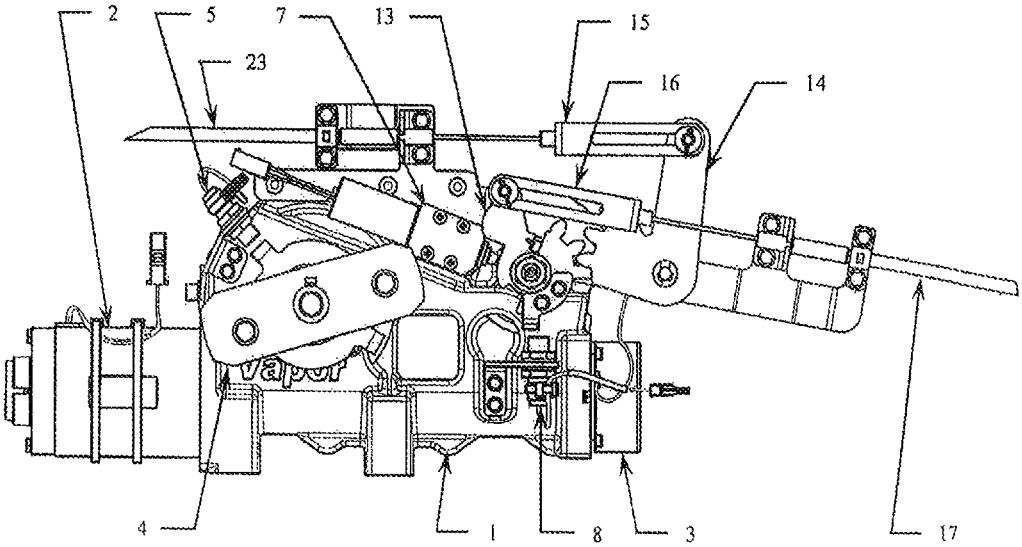
FIG. 3 is a plan view of an electric door operator according to this invention with a multiple means for manually pulling of a disengagement lever.
Figure 4:
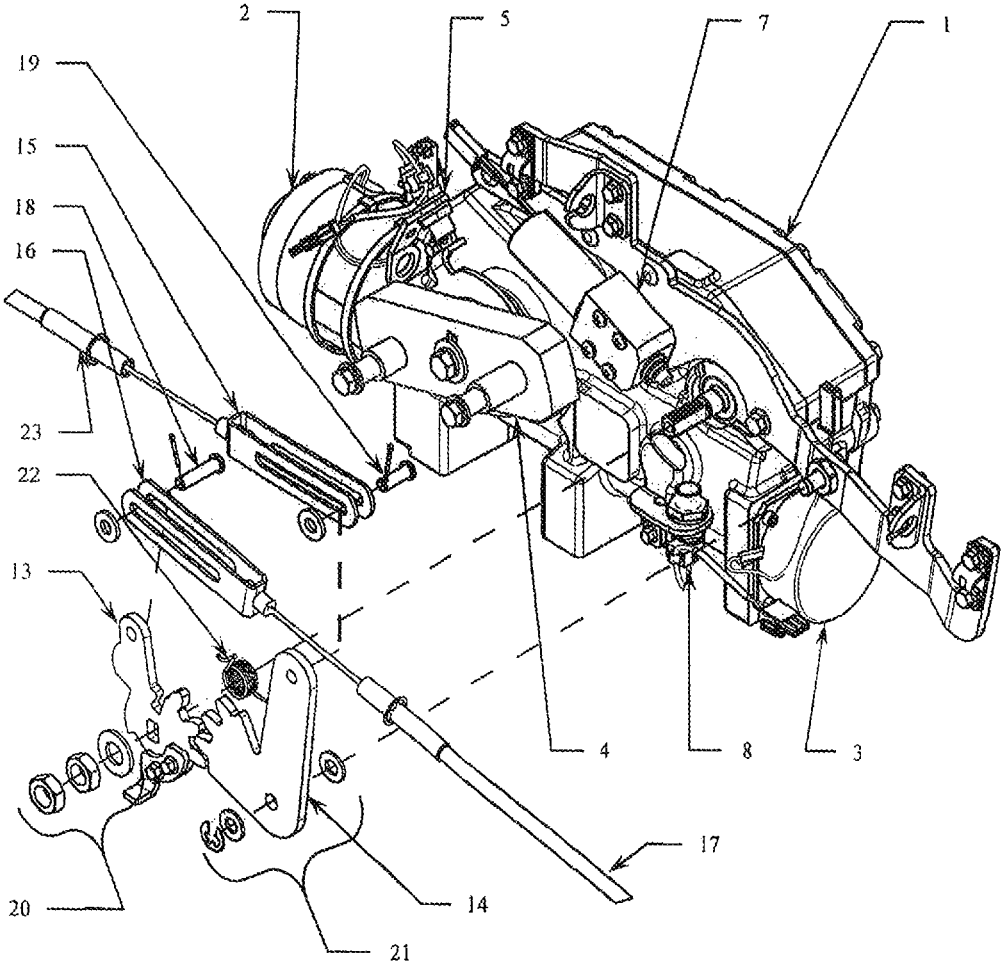
FIG. 4 is a partially exploded perspective view of the electric door operator shown in FIG. 3.

In FIGS. 3 and 4, an operator 1 is illustrated with an electric motor 2 on the left, an electrical lock 3 on the right, and a teeter 4 centrally located.

The operator 1 incorporates a primary lever arm 13 with an integral pinion sector. The lever arm 13 is secured to the manual release shaft extending from the operator by a slotted hole and nuts 20 or similar method such that forces acting upon the lever arm will rotate the manual release shaft which will disengage the teeter 4 from the motor 2 and lock 3.

A second lever arm 14 incorporates a gear sector intermeshed with the pinion sector of the primary lever arm 13 and is journaled to rotate on a pin fixed to the operator and parallel with the manual release shaft. The second lever arm is secured with clip and washers 21 to the pin. Force acting to rotate the primary lever arm will rotate the second lever arm and force acting on the second lever arm will rotate the primary lever arm. Pulling either lever arm will rotate the manual release shaft.

The length of the second lever arm 14 and the gear ratio of the two lever arms 13 and 14 allow the position of the end of the second lever arm to be adjusted to allow clearance as needed while maintaining the same pull force and stroke or to produce a higher or lower pull force as the application demands.

A slotted clevis end 16 is connected to the end of lever arm 13 by means of a clevis pin 18 or similar connection secured with a cotter pin or similar device. The slotted clevis end 16 is attached to the end of a Bowden cable 17 or similar means for transmitting force from a remote location. Likewise, a slotted clevis end 15 is connected to the end of the second lever arm 14 by means of a clevis pin 19. The slotted clevis end 15 is attached to a Bowden cable 23 or similar means for transmitting force from a remote location. The sheath of each Bowden cable is fixed relative to the operator.

The slot in the slotted clevis ends must be at least as long as the stroke of the lever arm to which the slotted clevis end is attached. Thus, if the primary lever arm is pulled to rotate and the second lever arm is caused to rotate also, the Bowden cable attached to the second lever arm does not need to move. Additionally, if the Bowden cable attached to the primary lever arm may be biased to automatically return after being pulled and can do so even though the latch solenoid has not released the manual release shaft.

A torsion spring 22 biases the manual release shaft and primary lever arm 13 in the engaged position, that is, to ensure return of the lever arm 13 to the engaged position. The plunger of a linear solenoid or similar device engages the lever arm 13 via a radial slot to latch the arm in the disengage position. A latch solenoid 7 prevents the return to the engage position until electrically activated to withdraw the plunger. The torsion spring 22 and latch solenoid 7 are able to act through the gear mesh to ensure positive return and locking, respectively, of the second lever arm.

A sensor 8 may be incorporated to provide feedback of the lever arm 13 position. A sensor S may be incorporated to provide feedback of the teeter 4 position.

Each Bowden cable is connected to separate manual pull-handles permitting two locations for one to manually disengage the doors. For example, one pull handle might be located in the vehicle interior accessible to passengers in an emergency. The other might be located behind an access panel on the exterior of the vehicle to permit the door to be disengaged in the event the vehicle does not have electrical power.

In another configuration, one cable can be connected to a manual pull-handle and the other to an electrical actuator to permit an electromechanical disengagement of the door with a manual backup. In yet another configuration, one of the cables can be connected to a pneumatic cylinder which would allow the doors to respond to a pneumatic pressure input from a vehicle's central pneumatic compression system or pneumatic parking brake.

Having thus described the invention with the detail and particularity required by the Patent Laws, what is desired protected by Letters Patent is set forth in the following claims.

The invention claimed is:

1. A dual manual disengagement mechanism for an electric transit door operator having a disengagement shaft extending from the operator comprising:

a first pinion lever secured to the disengagement shaft having a plurality of gear teeth;

a second pinion lever having a plurality of gear teeth intermeshed with the gear teeth of the first pinion lever such that when the first lever rotates with the disengagement shaft the second lever also rotates and vice versa;

a first pull means connected to the first pinion lever via a clevis end having an elongate slot, said first pull means extending in a first direction; and a second pull means connected to the second pinion lever via a clevis end having an elongate slot, said second pull means extending in a second direction generally opposite the first direction, and wherein the length of the slots in the clevis ends is such that the pulling of one pull means to rotate the disengagement shaft to the disengagement position will not cause a tug on the other pull means.

2. The dual manual disengagement mechanism of claim 1, wherein the first and second pull means are sheathed cables.

3. The dual manual disengagement mechanism of claim 1, wherein the first and second pinion levers are of equal length and the clevis ends have slots of equal length.

4. The dual manual disengagement mechanism of claim 1, wherein the first and second pinion levers are of unequal length and the clevis ends have slots of unequal length.

5. The dual manual disengagement mechanism of claim 1, wherein the gear teeth of the first and second pinion levers are in a gear ratio selected to provide the disengagement force required for a particular application.

6. The dual manual disengagement mechanism of claim 1, wherein the gear teeth of the first and second pinion levers are in a gear ratio and the first and second pinion levers have lengths selected to provide the disengagement force required for a particular application.

* * * * *